United States Patent [19]

Shimada et al.

[11] Patent Number: 4,842,780

[45] Date of Patent: Jun. 27, 1989

[54] SYSTEM FOR PREPARING GROUND-IMPREGNATING MATERIAL

[75] Inventors: Shunsuke Shimada; Takeshi Sato, both of Tokyo, Japan

[73] Assignees: Kyokado Engineering Co., Ltd.; Sanshin Corporation, both of Tokyo, Japan

[21] Appl. No.: 86,107

[22] Filed: Aug. 14, 1987

[30] Foreign Application Priority Data

Sep. 25, 1986 [JP] Japan ..... 61-227835

[51] Int. Cl.[4] ..... B01F 3/04

[52] U.S. Cl. ..... 261/64.3; 261/22; 405/269

[58] Field of Search ..... 261/20, 76, 118, 64.3, 261/64.1, 22; 405/263, 266, 269

[56] References Cited

U.S. PATENT DOCUMENTS

| | | | |
|---|---|---|---|
| 2,058,508 | 10/1936 | Rolle | 261/76 |
| 2,143,817 | 1/1939 | Longdin et al. | 261/76 X |
| 3,207,492 | 9/1965 | Zikesch | 261/118 X |
| 3,749,377 | 7/1973 | Slater et al. | 261/118 X |
| 4,152,409 | 5/1979 | Nagao et al. | 261/76 X |
| 4,173,178 | 11/1979 | Wieland | 261/76 X |
| 4,226,557 | 10/1980 | Kayahara | 405/269 |
| 4,369,115 | 1/1983 | Bauer | 261/76 X |
| 4,466,928 | 8/1984 | Kos | 261/76 |
| 4,514,112 | 4/1985 | Sano et al. | 405/269 |

FOREIGN PATENT DOCUMENTS 59-42769 10/1984 Japan .

*Primary Examiner*—Richard L. Chiesa
*Attorney, Agent, or Firm*—Martin A. Farber

[57] ABSTRACT

A system for preparing a ground impregnating material which comprises a line for feeding a base liquid component of the ground impregnating material, such as an aqueous sodium silicate solution, and a high pressure carbon dioxide gas bomb connected via a carbon dioxide gas delivery line to the base liquid component feed line. The carbon dioxide gas delivery line has a carbon dioxide blowing nozzle provided therein. The carbon dioxide gas blowing nozzle comprises a disk centrally perforated with a nozzle bore. A plurality of the carbon dioxide gas blowing nozzles having different opening diameters may be switchably provided in parallel in the carbon dioxide gas delivery line.

4 Claims, 4 Drawing Sheets

SYSTEM FOR PREPARING GROUND-IMPREGNATING MATERIAL

BACKGROUND OF THE INVENTION

1. Field of the Invention

The present invention relates to a system for preparing a consolidating medium which is injected into the ground to provide consolidation or water cut-off of the ground, or a material for such consolidating medium (which will be generally referred to as a ground impregnating material), and more particularly, to a system for producing a ground impregnating material, in which controlling of the absolute flow rate of a pressurized carbon dioxide gas is simplified, and carbon dioxide is permitted to join a base component of the ground impregnating material at a given ratio within a range of acceptable ground pressures.

2. Description of the Prior Art

There has been proposed a medium injection process for injecting a consolidating medium consisting essentially of a water glass (sodium silicate) and carbon dioxide gas serving as a hardening agent into a weak or water-leaked ground to provide consolidation or water cut-off of the ground.

In general, in injecting an aqueous sodium silicate solution and carbon dioxide gas into the ground in a joining manner, uniform aggregates of sodium silicate will not be formed unless carbon dioxide gas to be mixed is supplied at a substantially constant proportion in absolute quantity to the aqueous sodium silicate solution. This reason is as follows: If the pressure within the ground varies, the amount of carbon dioxide gas injected varies significantly, resulting in a failure to maintain a constant ratio to the sodium silicate, causing non-uniformity of a colloid material produced from the reaction of the sodium silicate and carbon dioxide gas. Consequently, a uniform aggregate is not provided.

For example, if the injection rate of the consolidating material into the ground is kept constant, the injection pressure normally varies from zero to about 20 kg/cm$^2$. On the contrary, the absolute amount of the aqueous sodium silicate solution would not vary even if the injection pressure varies, because the aqueous sodium silicate solution is liquid. However, carbon dioxide gas varies in volume and also in absolute amount due to the variation of injection pressure.

For one of the approaches to the above problems, there has been proposed a medium injection system as described in Japanese Patent Publication No. 42769/84. This proposed system comprises an injection pipe inserted into the ground, a sodium silicate storage tank connected to the interior of the injection pipe, and a carbon dioxide bomb connected to the interior of the injection pipe, wherein a pressure variation sensor is interposed between the carbon dioxide bomb and the injection pipe, the pressure variation senser being constituted of an automatic flow rate adjuster valve, a flow meter connected via a differential pressure transmitter and an opening and closing operator to a flow rate indication adjuster, and a pressure transmitting unit similarly connected via a graphic operator to the flow rate indication adjuster, these three components being connected sequentially between the injection pipe and the carbon dioxide gas bomb, so that the absolute flow rate of carbon dioxide gas is controlled by the automatic flow rate adjuster valve being operated by the flow rate indication adjuster on the basis of the results of calculation in both of the operators, thereby injecting the aqueous sodium silicate solution and the carbon dioxide gas in a joining manner at a constant ratio of their absolute flow rates.

The above prior art injection system can provide an advantage that the provision of the pressure variation sensor between the carbon dioxide bomb and the injection pipe makes it possible to inject the aqueous sodium silicate solution and carbon dioxide gas into a ground in the joining manner at a constant ratio of their absolute flow rates, irrespective of a variation in ground pressure (kg/cm$^2$). In practice with this system, however, there is a necessity for a complicated control system for sensing a pressurized carbon dioxide gas in an amount to correspond to the ground pressure, resulting in an increased cost of equipment for the control system, and also providing practical problems of requirements for checks in performance, control and maintenance of individual control elements as well as careful control of operation.

SUMMARY OF THE INVENTION

It is therefore an object of the present invention to provide a system for producing a ground impregnating material, wherein controlling of the entire flow rate of a pressurized carbon dioxide gas is simplified, and the carbon dioxide gas is permitted to join a base component of the ground impregnating material at a given ratio within a range of acceptable ground pressures and wherein the problems found in the above prior art can be overcome.

According to the present invention, the above object is accomplished by providing a system for preparing a ground impregnating material, comprising a line for feeding a base liquid component of the ground impregnating material, such as e.g. an aqueous sodium silicate solution, and a high pressure carbon dioxide gas bomb connected via a carbon dioxide gas delivery line to the liquid component feed line, the carbon dioxide gas delivery line having a carbon dioxide blowing nozzle provided therein the nozzle having a disk centrally perforated with a nozzle bore.

With such construction, the amount of carbon dioxide gas blown corresponding to a ground pressure within a predetermined range can be provided only by the selection of the opening diameter of the blowing nozzle and the pressure of the carbon dioxide gas respectively at any desired level. Thus, the aqueous sodium silicate solution and the carbon dioxide gas can be injected into the ground in such a manner that they may be permitted to join each other at a given ratio even if the ground injection pressure varies. This provides an effect that a uniform aggregate is formed.

Moreover, controlling of the flow rate of carbon dioxide gas is provided by the carbon dioxide gas blowing nozzle, leading to a simplified medium injecting operation and also providing great improvements in ease of medium injection and in cost.

The above and other objects, features and advantages of the invention will become apparent from reading of the following description of preferred embodiments thereof, taken in conjunction with the accompanying drawings.

DETAILED DESCRIPTION OF PREFERRED EMBODIMENTS

Figure 1:
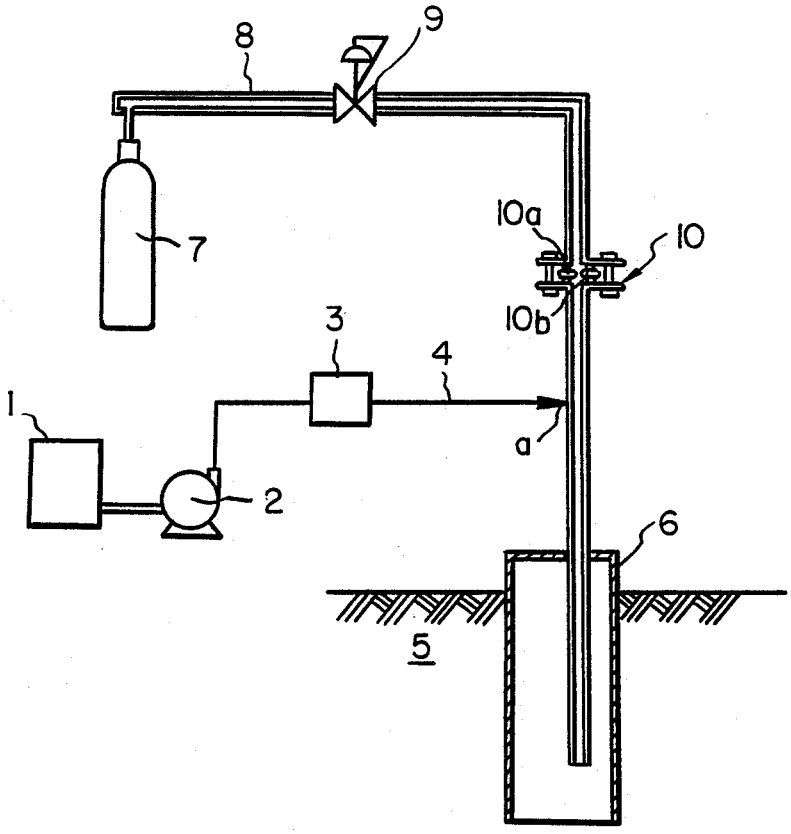
FIGS. 1 and 2 are schematic diagrams illustrating a basic concept of the present invention.

FIG. 1 shows an arrangement diagram illustrating a basic concept of the present invention, and in this figure, the reference numeral 1 designates a storage tank for a base component for a ground impregnating material, such as an aqueous sodium silicate solution, a reactant-containing aqueous sodium silicate solution and water. The reference numeral 2 is an injection pump, the numeral 3 being a flow meter, the numeral 4 being a base component feed line, the numeral 5 being the ground, the numeral 6 being an injection pipe, the numeral 7 being a high pressure carbon dioxide gas bomb, the numeral 8 being a carbon dioxide gas delivery line, the numeral 9 being a pressure reducing valve, and the numeral 10 being a carbon dioxide gas blowing nozzle comprising a disk 10*a* centrally perforated with a nozzle bore 10*b*.

In the present invention, the base component feed line 4 is connected to the high pressure carbon dioxide gas bomb 7 by connection with the carbon dioxide gas delivery line 8, for example, at a junction a. Alternatively, the connection of the base component feed line 4 with the carbon dioxide gas delivery line 8 may be provided within the injection pipe 6. Further, in the present invention, the pressure reducing valve 9 and the carbon dioxide gas blowing nozzle 10 are sequentially provided in the carbon dioxide gas delivery line 8. Alternatively, a plurality of carbon dioxide gas blowing nozzles 10 of different opening sizes or diameters may be switchably provided in parallel in the carbon dioxide gas delivery line 8, as shown in detail in FIG. 5.

Description will now be made of the operation of the system according to the present invention. First, an embodiment which uses an aqueous sodium silicate solution as a base component for a ground impregnating material will be described with reference to FIG. 1. The aqueous sodium silicate solution is introduced from the storage tank 1 via the pump 2 and the flow meter 3 and through a line 4 into the line 8.

On the other hand, carbon dioxide gas is passed from the high pressure carbon dioxide gas bomb 7 through the line 8, then through the pressure reducing valve 9 and further through the nozzle bore 10*b* centrally made in the disk 10*a* to join the aqueous sodium silicate solution at the junction a, thereby forming a ground impregnating material in the form of a consolidating liquid. The resulting ground impregnating material is introduced into the injection pipe 6 inserted in the ground 5 and is then injected into the ground 5.

Then, an embodiment using water as a base component for a ground impregnating material will be described with reference to FIG. 2.

Water within the storage tank 1 is introduced in the same manner as in FIG. 1 via the pump 2 and the flow meter 2 and through the line 4 into the line 8. On the other hand, carbon dioxide gas is passed in the same manner as in FIG. 1 from the high pressure carbon dioxide gas bomb through the line 8, then through the pressure reducing valve 9 and further through the nozzle bore 10*b* centrally made in the disk 10*a* to join the water at the junction a, thereby forming a ground impregnating material in the form of an aqueous carbonic acid solution (reactant).

Further provided in such an arrangement of the present invention is an additional storage tank 1' which contains an aqueous sodium silicate solution therein. When the aqueous sodium silicate solution is introduced from the storage tank 1' via a pump 2' and a flow meter 3 and through a line 4 into the line 8 at a junction b, it joins the aqueous carbonic acid solution to form a ground impregnating material which is subsequently introduced into the injection pipe 6 inserted in the ground 5 and is then injected into the ground.

Figure 2:
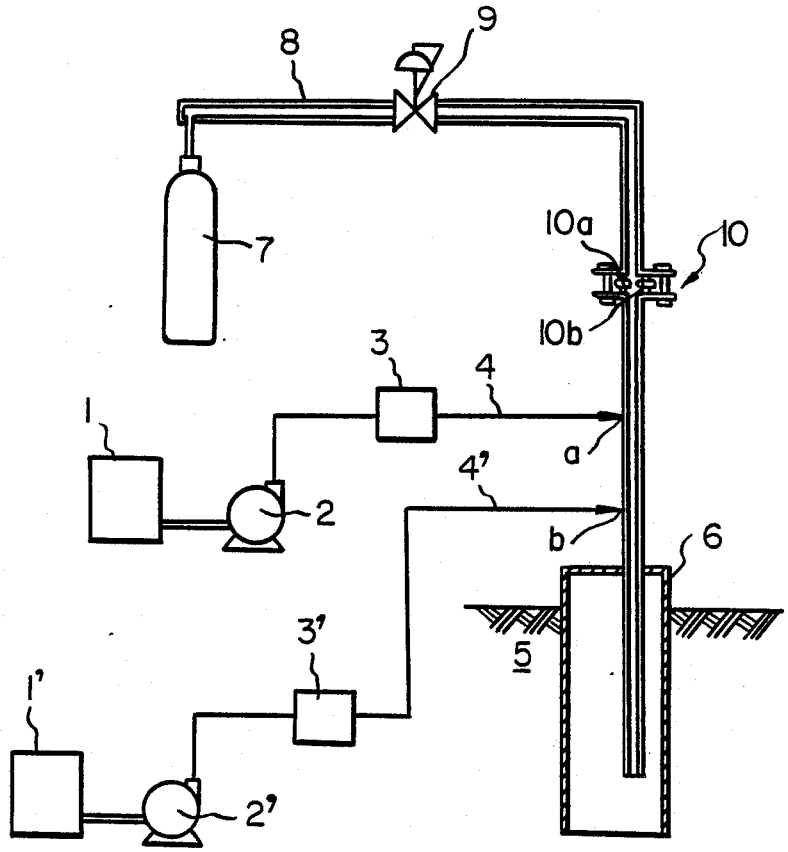
Figure 3:
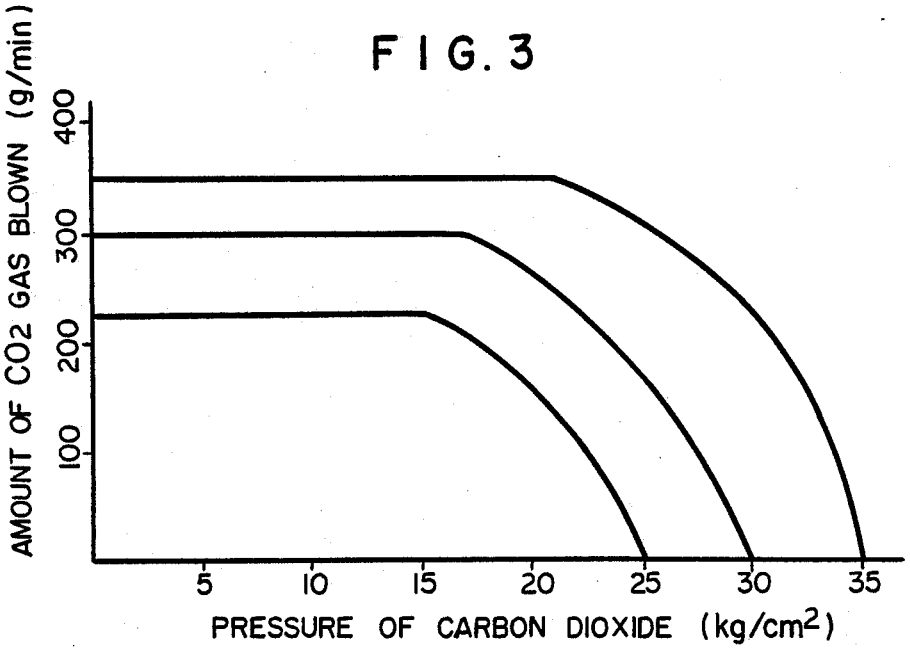
FIG. 3 is a graph illustrating a relationship between pressures of carbon dioxide gas and amount of carbon dioxide gas blown.

A relationship between pressure of carbon dioxide gas and amount of carbon dioxide gas blown in each of the above systems shown in FIGS. 1 and 2 is as illustrated in FIG. 3.

FIG. 3 is a graph illustrating a relationship between pressures of carbon dioxide gas (35, 30 and 25 kg/cm$^2$) and amounts of carbon dioxide gas blown, with the use of a 0.8 mm diameter nozzle bore 10*b* centrally perforated in the disk 10*a* (2 mm thick). It can be seen from FIG. 3 that the amounts (g/min.) of carbon dioxide gas blown at set pressures of carbon dioxide gas are constant in flow rate within a certain range, but are gradually reduced as a certain limit is exceeded. Therefore, the amount of carbon dioxide gas blown corresponding to the ground pressure can be controlled by varying the pressure of carbon dioxide gas. The pressure of carbon dioxide gas can be varied to a desired level by the pressure reducing valve 9.

Figure 4:
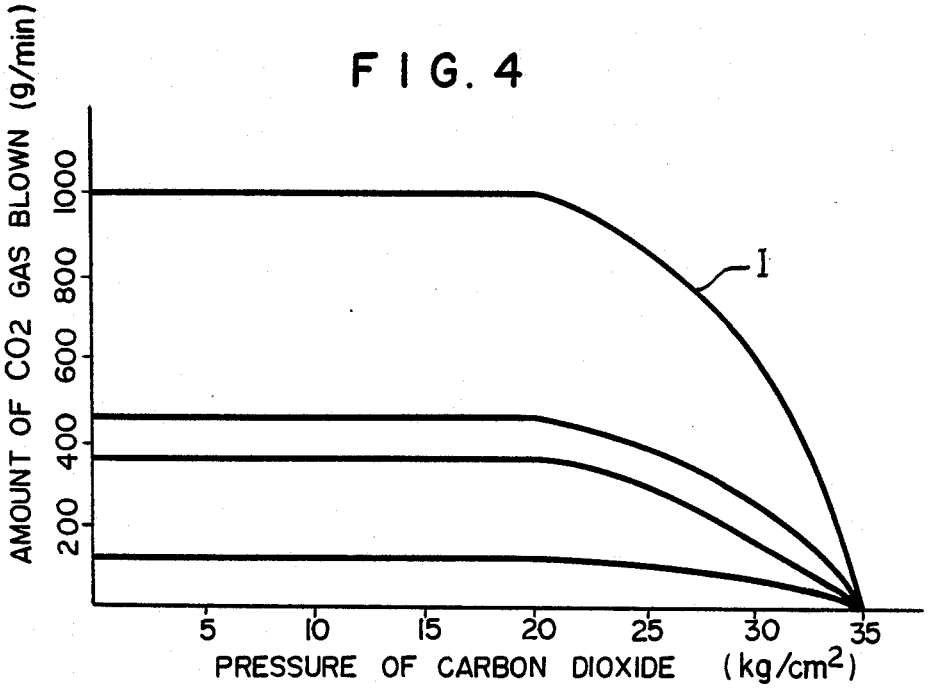
FIG. 4 is a graph illustrating a relationship between nozzle opening diameters and amount of carbon dioxide gas blown.

FIG. 4 illustrates a relationship between a pressure of carbon dioxide gas set at a given level (35 kg/cm$^2$) and the amounts of carbon dioxide gas blown with different opening diameters of nozzle bores. In this case, it is possible to control the amount of carbon dioxide gas blown corresponding to the ground pressure to any desired level by combination of a plurality of carbon dioxide gas blowing nozzles of different opening sizes or diameters.

In FIG. 4, a line I indicates an amount of carbon dioxide gas blown when two nozzles each having an opening diameter of 1 mm (amount of carbon dioxide gas blown for each nozzle: 450 g/min.) and one nozzle having an opening diameter of 0.4 mm (amount of carbon dioxide gas blown: 100 g/min.) are used in combination.

It can be seen from FIG. 4 that carbon dioxide gas blowing nozzles of different opening diameters can be also used by replacement to correspond to the ground pressure when the pressure of carbon dioxide gas is set at a given level.

As described above, with the system of the present invention, the base component for the ground impregnating material can be permitted to join carbon dioxide gas at a constant ratio by determining the pressure of carbon dioxide gas and the opening diameter of the carbon dioxide gas blowing nozzle such that the amount of carbon dioxide gas blown may be constant independently of a variation in ground pressure in mixing or joining between the base component and carbon dioxide gas. It is to be noted that the pressure of carbon dioxide gas can be selected at any level by the operation of the pressure reducing valve 9, and the opening diameter can be selected at any level by replacing the nozzle 10 by a nozzle 10 having a different opening diameter.

Figure 5:
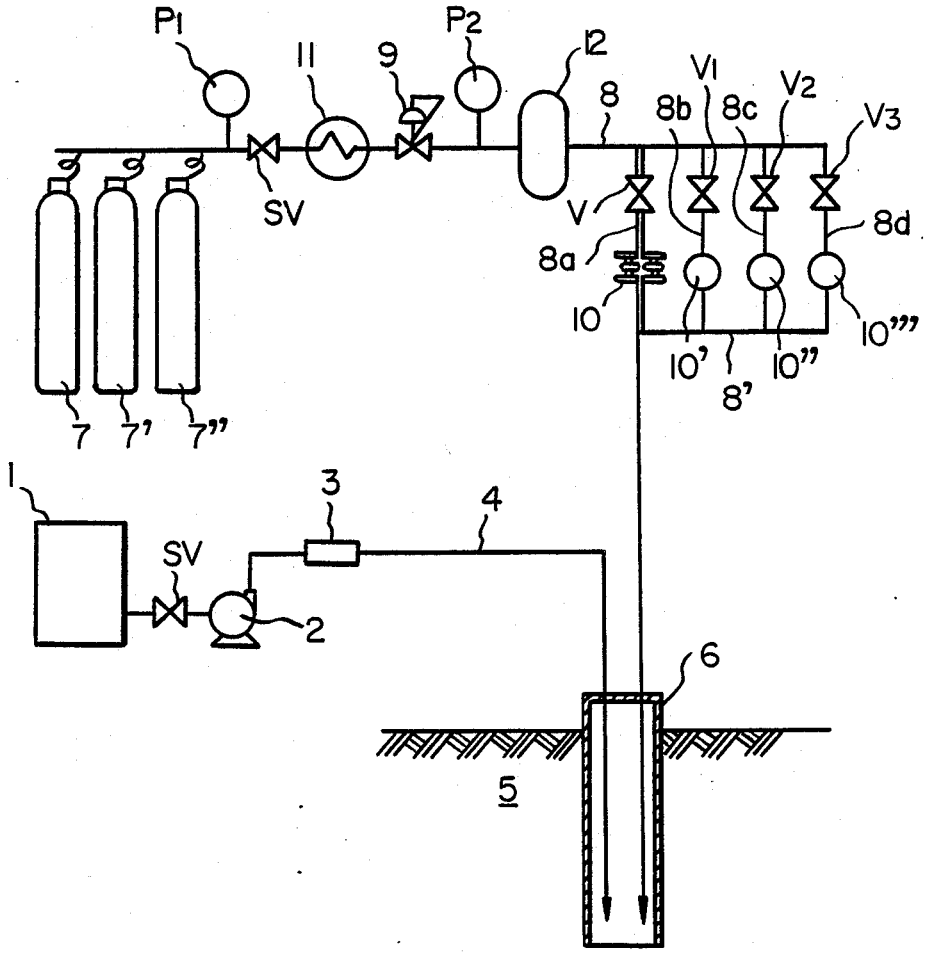
FIG. 5 is a diagram illustrating another embodiment of the present invention.

Referring to FIG. 5, there is shown another embodiment of the present invention, wherein the line 4 is inserted into the injection pipe 6, and a plurality of carbon dioxide gas blowing nozzles are provided. In this embodiment, a aqueous sodium silicate solution stored in the storage tank 1 is discharged therefrom in a given amount by the injection pump 2 and observed in flow rate by the flow meter. Such solution is then passed through the line 8 into the injection pipe 6 inserted in the ground 5. A starter valve SV is provided in the line 4 upstream of the injection pump 2.

The carbon dioxide gas delivery line 8 is connected to mouthpieces of high pressure liquefied-carbon dioxide gas bombs 7, 7' and 7'' and this piping is provided with a starter valve SV, a heater 11, a pressure reducing valve 9, and a carbon dioxide gas reservoir 12. A liquefied carbon dioxide gas is converted into a gasified carbon dioxide gas by the heater 11 and then reduced to a predetermined pressure through the pressure reducing valve 9. Thus, the resulting carbon dioxide gas is stored at such predetermined pressure in the carbon dioxide gas reservoir 12. Branch pipes 8*a*, 8*b*, 8*c* and 8*d* are provided in parallel in the line 8 downstream of the gas reservoir 12 and have starter valves V, V1, V2 and V3 and carbon dioxide gas blowing nozzles 10, 10', 10'' and 10''' respectively provided therein. Each of the branch pipes is connected to a line 8' which is connected to the carbon dioxide gas delivery line 8. The terminal of the line 8 is connected to the injection pipe 6. The pressure of carbon dioxide gas pumped is observed by pressure gauges P1 and P2 provided in the line 8.

The carbon dioxide gas blowing nozzles 10, 10', 10'' and 10''' have different opening diameters, so that the amount of carbon dioxide gas blown may be controlled by the single blowing nozzle or by the combination of the two or more blowing nozzles, whereby the aqueous sodium silicate solution and carbon dioxide gas may be injected into the ground through the injection pipe 6 in such a manner to join each other at a constant ratio of their flow rates.

What is claimed is:

1. A system for preparing a ground impregnating material, comprising a feed line for feeding a base liquid component of the ground impregnating material, a carbon dioxide gas delivery line, and gas means for supplying carbon dioxide gas at a predetermined pressure, said gas means including a high pressure carbon dioxide gas bomb and a pressure reduction valve connected to an outlet of the bomb, said valve being connected via said carbon dioxide gas delivery line to the base liquid component feed line, the carbon dioxide gas delivery line having a carbon dioxide blowing nozzle provided therein, said carbon dioxide blowing nozzle comprising a disk centrally perforated with a nozzle bore which is sized to provide a substantially constant flow speed of carbon dioxide independent of back pressure over a predetermined region of back pressure, thereby to fill interstices in the earth with ground impregnating material.

2. A system according to claim 1, wherein a plurality of said carbon dioxide gas blowing nozzles having different opening diameters are switchably provided in parallel in said carbon dioxide gas delivery line.

3. The system according to claim 1, further comprising an injection pipe disposed in the ground and connected to one of said lines.

4. The system according to claim 3, wherein said injection pipe forms the connection of the gas bomb via said delivery line to the feed line.

* * * * *